United States Patent [19]

Denoyelle et al.

[11] 4,284,968

[45] Aug. 18, 1981

[54] ADJUSTABLE ELECTROMAGNETIC TRIPPING MECHANISM FOR A CIRCUIT-BREAKER

[75] Inventors: Serge Denoyelle; Pierre Noisette, both of Saint-Quentin, France

[73] Assignee: Alsthom-Unelec, Paris, France

[21] Appl. No.: 105,170

[22] Filed: Dec. 19, 1979

[30] Foreign Application Priority Data

Jan. 4, 1979 [FR] France ..... 79 00150

[51] Int. Cl.[3] ..... H01H 71/74

[52] U.S. Cl. ..... 335/176; 335/42

[58] Field of Search ..... 335/176, 42, 45; 337/258, 273

[56] References Cited

U.S. PATENT DOCUMENTS

| | | | |
|---|---|---|---|
| 2,920,161 | 1/1960 | Dessert et al. | 335/45 |
| 4,023,132 | 5/1977 | Kidd et al. | 335/176 |

*Primary Examiner*—Harold Broome

*Attorney, Agent, or Firm*—Sughrue, Rothwell, Mion, Zinn and Macpeak

[57] ABSTRACT

An adjustable electromagnetic tripping mechanism for a circuit-breaker, includes in each pole, a fixed magnetic circuit excited by the current passing through the said pole. A movable magnetic member is held by the force of a return spring against a stop at a predetermined distance from the fixed magnetic circuit. A movable adjusting element bears the stop and includes a point of support or of attachment of the said return spring, which enables the limiting operating current of the circuit-breaker to be varied. The movement of the said movable adjusting element modifies at the same time and in the same sense of variation, firstly the distance predetermined by the stop between the movable magnetic member and the fixed magnetic circuit, and secondly the force exerted by the return spring upon the movable magnetic member. The invention is characterized in that the movable adjusting element consists of a small plate of generally plane form guided in translation in slides.

2 Claims, 5 Drawing Figures

F

IM
Io
Im
RETURN FORCE
FM
Fo
Fm
E''M
F''M
E'M
F'M
E'm
F'm
E''m
F''m
Em
Eo
EM
E
ELECTROMAGNETIC FORCE

ADJUSTABLE ELECTROMAGNETIC TRIPPING MECHANISM FOR A CIRCUIT-BREAKER

FIELD OF THE INVENTION

The present invention refers to an adjustable electromagnetic tripping mechanism for a circuit-breaker. It refers more especially to the manners of producing a regulating device which enables the value of the limiting operating current of such a circuit-breaker to be varied.

BACKGROUND

Electromagnetic tripping mechanisms for circuit-breakers include as known, have associated with each of the poles of the circuit-breaker, a fixed magnetic circuit excited by the current passing through the pole and a movable magnetic member held by a return spring against a stop at a certain distance from the fixed magnetic circuit, thus defining the initial working gap of the tripping mechanism. When the current passing through the pole exceeds a certain value, the force of attraction, which is exerted between the fixed magnetic circuit and the movable magnetic member, becomes greater than the force exerted by the return spring. The movable magnetic member is then violently drawn against the fixed magnetic circuit and causes tripping of the circuit-breaker by freeing a catch in the mechanism of the circuit-breaker.

The practice is known of making the limiting operating current of these tripping mechanisms vary by acting either upon the force exerted by the return spring or upon the value of the initial working gap.

Thus, French Pat. No. 1 401 630 describes an adjusting device which enables the elongation of the return spring of the movable magnetic member to be varied. Similarly French Pat. No. 2 161 615 describes an adjusting device which enables the position of the stop of the movable magnetic member to be varied.

These devices display the disadvantage of necessitating a considerable bulk if it is required to have available a wide range of adjustment of the limiting operating current. In addition, because of manufacturing tolerances, the accuracy of the adjustment carried out by the user decreases rapidly the further that one moves away from the reference position adjusted in manufacture by the manufacturer for a defined value of the limiting operating current.

An adjusting device is likewise known from the U.S. Pat. No. 2,920,161, which acts simultaneously upon the force exerted by a return spring and upon the value of the gap but in a complicated arrangement which does not allow of any saving of space to be achieved.

The object of the present invention is to provide a device which acts equally simultaneously upon a return spring and upon the gap but which is much simpler and much flatter and enables a wide range of adjustment to be obtained of the limiting operating current with small bulk whilst ensuring good accuracy over the whole range of adjustment.

SUMMARY OF THE INVENTION

The present invention provides an adjustable electromagnetic tripping mechanism for a circuit-breaker, including in each pole:

a fixed magnetic circuit excited by the current passing through the said pole;

a movable magnetic member held by the force of a return spring against a stop at a predetermined distance from the fixed magnetic circuit;

a movable adjusting element bearing said stop and including a point of support or of attachment of said return spring. This enables the limiting operating current of the circuit-breaker to be varied, and the movement of said movable adjusting element modifies at the same time and in the same sense of variation, firstly the distance predetermined by the said stop between the movable magnetic member and the fixed magnetic circuit, and secondly the force exerted by the said return spring upon the movable magnetic member. The invention is characterized in that the movable adjusting element consists of a small plate of generally plane form guided in translation in slides.

Preferably movable adjusting elements of each of the poles are connected to a common adjusting bar the movement of which causes simultaneous movement of all of the movable adjusting elements and the bar has a generally plane form, the movement of which is carried out in a plane parallel or coincident with the plane of movement of the movable adjusting elements.

BRIEF DESCRIPTION OF THE DRAWINGS

Other characteristics and advantages of the invention will be more clearly evident from the description which follows of a non-restrictive embodiment, associated with the drawing where.

DETAILED DESCRIPTION

Figure 1:
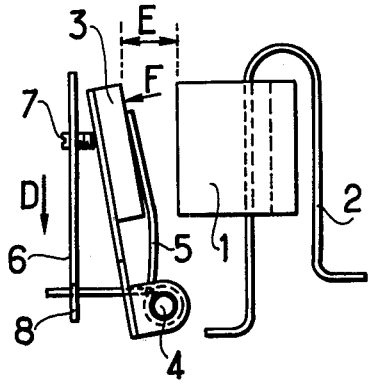
FIG. 1 is an elevational view which shows a view in profile of an adjustable electromagnetic tripping mechanism in accordance with the invention.
Figure 2:
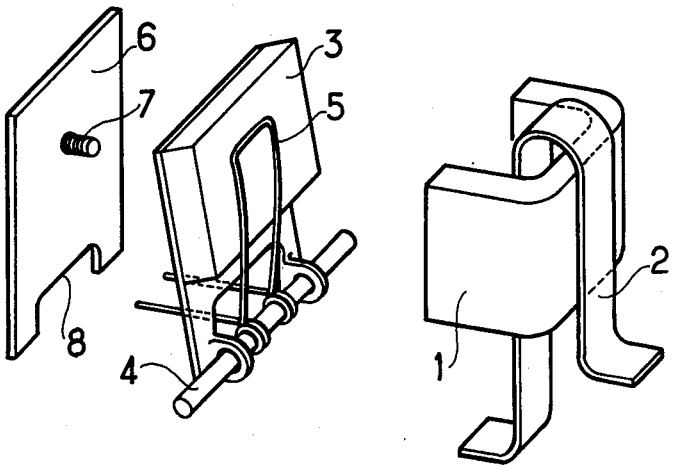
FIG. 2 is an exploded perspective view of the parts of the tripping mechanism represented in FIG. 1.

Referring to FIGS. 1 and 2 the tripping mechanism includes in each pole:

a fixed magnetic circuit element 1 surrounded by a conductor of the excitation current 2;

a magnetic blade 3 mounted to be movable about an axis of axel 4 and subjected to the force F of a return spring 5;

an adjusting element 6 consisting of a small plate of generally plane form mounted so as to be able to move in translation in slides (not shown) parallel to the plane of the face of the plate as per arrow D and carrying firstly an adjustable screw 7 forming a stop for the magnetic blade 3 and defining an initial working gap E and secondly a notch 8 forming a point of attachment for the return spring 5.

It may clearly be seen from FIG. 1 that if the movable adjusting element 6 is moved in the direction of the arrow D, firstly the movement of the screw 7 brings about an increase in the initial gap E and hence an increase in the limiting operating current, and secondly the movement of the notch 8 brings about an increase in the force F exerted by the return spring 5 and hence also an increase in the limiting operating current. Of course the effect is reversed if the movement of the movable adjusting element 6 is carried out in the reverse direction. Thus it may be seen that for one and the same movement of the movable adjusting element a greater variation of the limiting operating current is obtained than if the movable adjusting element acted only upon the initial gap E or only upon the return force F.

Figure 3A:
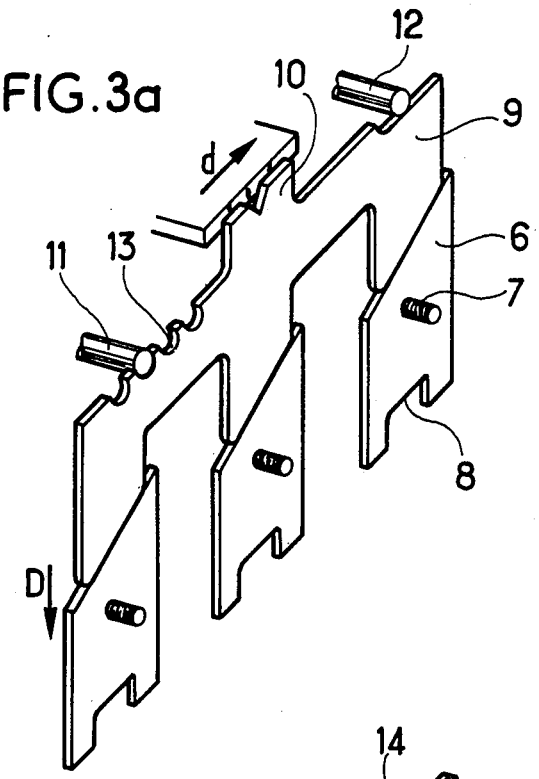
FIGS. 3*a* and 3*b* are perspective views and show two ways of producing a regulating device which acts simultaneously upon all of the poles of a circuit-breaker in accordance with the invention.
Figure 3B:
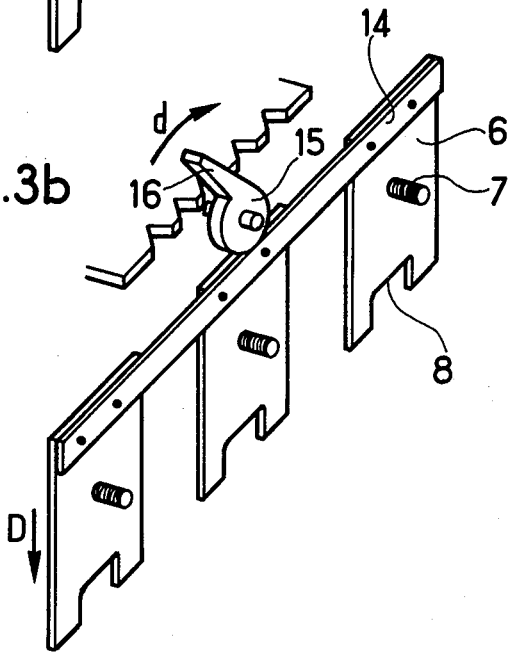

The movements of the movable adjusting element 6 in order to obtain various values of the limiting operating current may be achieved by separate means upon each of the poles such, for example, as adjusting screws or cams which bear respectively upon each of the movable adjusting elements. But it is obviously preferable to employ a means of adjustment common to all of the poles of the apparatus. FIGS. 3*a* and 3*b* give two non-restrictive embodiments of it.

In FIG. 3*a* the movable adjusting element 6 of each pole carries at its upper portion a sloping profile kept bearing against a corresponding profile on a common adjusting bar 9 carrying an adjusting pointer 10. The common bar 9 bears against studs 11 and 12, and notches 13 which prevent unintentional sliding of the bar 9. The whole of the parts are kept in contact by return springs (not shown) each of which exerts a force upon the corresponding notch 8. The bar 9 and the adjusting elements 6 are movable in one and the same plane but along perpendicular directions. Thus the movement of the adjusting pointer 10 in the direction of the arrow d brings about the movement in the direction of the arrow D of all of the movable adjusting elements 6.

In FIG. 3*b* the movable adjusting elements 6 are integral with a common adjusting bar 14 which bears against a cam 15 equipped with an adjusting pointer 16. There again the movement of the adjusting pointer 16 in the direction of the arrow d brings about the movement of all of the movable adjusting elements 6 in the direction of the arrow D.

The screws 7 carried by the movable adjusting elements 6 enable the initial gap E of each pole to be adjusted in manufacture for a chosen position of the adjusting pointer and hence the inevitable variations due to manufacturing tolerances to be corrected by an accurate adjustment. This enables one and the same value of the limiting operating current to be guaranteed for each pole of the apparatus and the spread across the limiting operating currents between the apparatus of one and the same manufacturing series to be restricted within a narrow zone.

Figure 4:
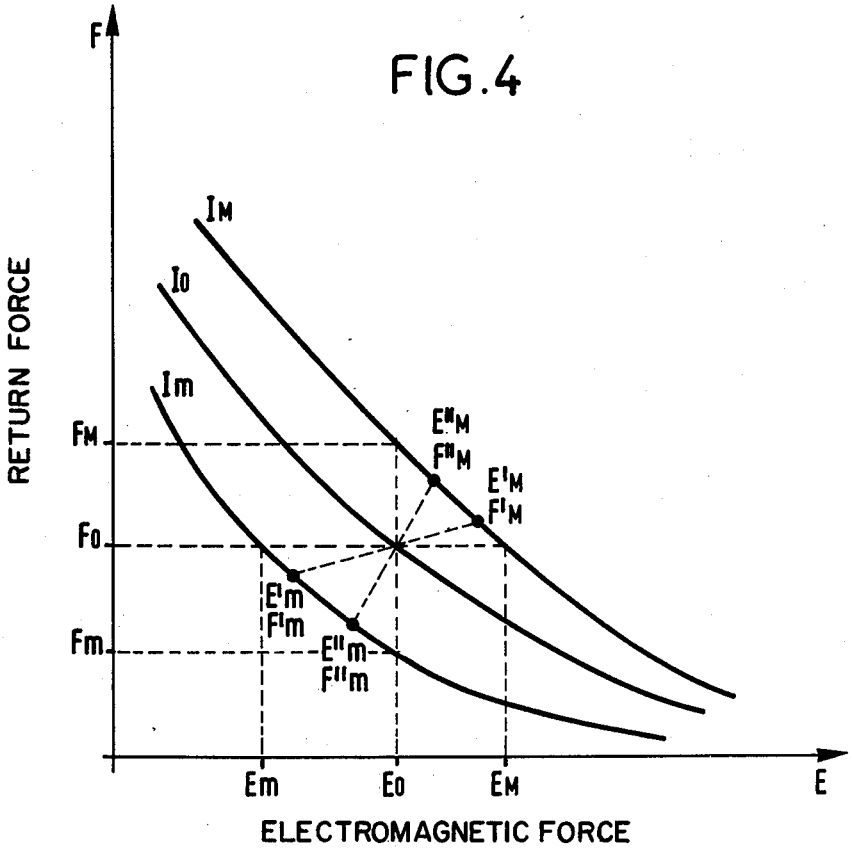
FIG. 4 is a plot which shows diagrammatically with the aid of curves of electromagnetic force and of force of return, the advantages secured by the present invention.

In order the better to grasp the advantages secured by the invention, reference will be made to FIG. 4 where by way of example is drawn as a function of the initial gap the electromagnetic force which is exerted upon the movable magnetic member for various values of the excitation current, a minimum value $I_m$, an average value $I_o$ and a maximum value $I_M$. It will be assumed that $I_o$ has been chosen as the average value of the limiting operating current and that a possible range of adjustment is desired from $I_m$ to $I_M$. On the corresponding curve at $I_o$ a point of operation is chosen which is defined by an initial gap $E_o$ and a force of return $F_o$. It is then seen that if it is desired to ensure possible adjustment between $I_m$ and $I_M$ by making only the force of return vary, that demands making this force vary from $F_m$ to $F_M$. Similarly if only the initial gap is made to vary that demands a variation from $E_m$ to $E_M$. On the contrary, if the initial gap and the force of return are made to vary simultaneously and in the same sense it may be seen that the same result is obtained with a variation going from ($E'_m$, $F'_m$) to ($E'_M$, $F'_M$) or from ($E''_m$, $F''_m$) to ($E''_M$, $F'_M$). Hence for one and the same range of adjustment of the limiting operating current one has firstly a minimum variation of the parameters of adjustment E and F, and secondly a wide latitude of choice about the laws of variation of E and F as a function of the position of the adjusting elements. In particular a law of variation may be chosen which minimizes the effect of the manufacturing tolerances and consequently a good accuracy be ensured over the whole range of adjustment.

Of course without departing from the scope of the invention other variants may be realized upon the adjustable electromagnetic tripping mechanism than that previously described, given by way of embodiment and exhibiting no exhaustive character.

In particular the movable magnetic member might just as well be a plunger core endowed with a motion of translation, and the return spring might similarly just as well be a tension, compression or leaf spring. The movable adjusting element may similarly have a motion of rotation or any other kind of motion in three dimensions in space. Finally the common adjusting device may adopt various forms depending upon the type of circuit-breaker with which the tripping mechanism in accordance with the invention might be associated.

We claim:

1. An adjustable electromagnetic tripping mechanism for a circuit-breaker having at least one pole, including in each pole: a fixed magnetic circuit element excited by the current passing through said pole; a movable magnetic member, a stop, and a return spring for holding said movable magnetic member by the force of said return spring, against said stop at a predetermined distance from the fixed magnetic circuit element; a movable adjusting element bearing said stop and including a point of attachment of said return spring, which enables the limiting operation current of the circuit-breaker to be varied, such that movement of said movable adjusting element modifies at the same time and in the same sense of variation, firstly the distance predetermined by said stop between the movable magnetic member and the fixed magnetic circuit element, and secondly the force exerted by said return spring upon the movable magnetic member, the improvement wherein said movable adjusting element consists of a small plate of generally plane form guided in translation in slides for movement in a direction parallel to the face of said plate.

2. An adjustable electromagnetic tripping mechanism as claimed in claim 1, wherein the circuit-breaker includes a plurality of poles and the movable adjusting elements of each of the poles are connected by a common adjusting bar the movement of which causes simultaneous movement of all of the movable adjusting elements said bar having a generally planar form and the bar is supported for movement which is carried out in a plane parallel or coincident with the plane of movement of the movable adjusting elements.

* * * * *